US009540704B2

(12) United States Patent
Fujihara et al.

(10) Patent No.: US 9,540,704 B2
(45) Date of Patent: Jan. 10, 2017

(54) METHOD OF MAKING QUENCHED AND TEMPERED STEEL PIPE WITH HIGH FATIGUE LIFE

(71) Applicant: NISSHIN STEEL CO., LTD., Tokyo (JP)

(72) Inventors: Masaru Fujihara, Hiroshima (JP); Tsunetoshi Suzaki, Hiroshima (JP)

(73) Assignee: NISSHIN STEEL CO., LTD., Tokyo (JP)

( * ) Notice: Subject to any disclaimer, the term of this patent is extended or adjusted under 35 U.S.C. 154(b) by 333 days.

(21) Appl. No.: 14/222,973

(22) Filed: Mar. 24, 2014

(65) Prior Publication Data

US 2014/0202600 A1 Jul. 24, 2014

Related U.S. Application Data

(62) Division of application No. 12/760,942, filed on Apr. 15, 2010, now abandoned.

(51) Int. Cl.

| | |
|---|---|
| ***C21D 9/08*** | (2006.01) |
| ***C21D 8/10*** | (2006.01) |
| ***C21D 1/18*** | (2006.01) |
| ***C22C 38/26*** | (2006.01) |
| ***C22C 38/28*** | (2006.01) |

(52) U.S. Cl.

CPC ..... *C21D 9/085* (2013.01); *C21D 1/18* (2013.01); *C21D 8/10* (2013.01); *C21D 8/105* (2013.01); *C21D 9/08* (2013.01); *C22C 38/26* (2013.01); *C22C 38/28* (2013.01); *C21D 2211/004* (2013.01)

(58) Field of Classification Search

None

See application file for complete search history.

(56) References Cited

U.S. PATENT DOCUMENTS

| | | | | |
|---|---|---|---|---|
| 6,878,219 | B2 * | 4/2005 | Kondo | C21D 8/10 148/333 |
| 7,727,463 | B2 * | 6/2010 | Arai | C21D 8/105 148/333 |
| 2006/0219333 | A1 * | 10/2006 | Samamoto | C21D 8/10 148/593 |
| 2006/0231168 | A1 | 10/2006 | Nakamura et al. | |
| 2007/0101789 | A1 | 5/2007 | Kondo et al. | |
| 2008/0226491 | A1 * | 9/2008 | Satou | B23K 11/0873 420/90 |
| 2009/0047166 | A1 | 2/2009 | Tomomatsu et al. | |
| 2009/0250146 | A1 * | 10/2009 | Ishitsuka | C21D 6/004 148/645 |
| 2009/0277544 | A1 | 11/2009 | Toyoda et al. | |
| 2011/0259482 | A1 * | 10/2011 | Peters | C21D 1/25 148/590 |
| 2012/0103459 | A1 * | 5/2012 | Fujihara | C21D 8/10 138/177 |

FOREIGN PATENT DOCUMENTS

| | | |
|---|---|---|
| EP | 2028284 | 2/2009 |
| JP | 6-264177 | 9/1994 |
| JP | 7-215038 | 8/1995 |

* cited by examiner

*Primary Examiner* — George Wyszomierski

(74) *Attorney, Agent, or Firm* — Clark & Brody

(57) ABSTRACT

A method for producing a high fatigue life quenched/tempered steel pipe comprises a quenching treatment of keeping an unquenched starting steel pipe having a composition that comprises, % by mass, C: 0.1 to 0.4%, Si: 0.5 to 1.5%, Mn: 0.3 to 2%, P: at most 0.02%, S: at most 0.01%, Cr: 0.1 to 2%, Ti: 0.01 to 0.1%, Nb: 0.01 to 0.1%, Al: at most 0.1%, B: 0.0005 to 0.01%, and N: at most 0.01%, with a balance of Fe and inevitable impurities, at 900 to 1100° C. for 10 to 60 seconds and then rapidly cooling it. The cooled pipe is subjected to a tempering treatment of keeping the pipe at 280 to 380° C. for 10 to 60 minutes.

3 Claims, No Drawings

METHOD OF MAKING QUENCHED AND TEMPERED STEEL PIPE WITH HIGH FATIGUE LIFE

This application is a Divisional of U.S. Ser. No. 12/760,942 filed on Apr. 15, 2010.

BACKGROUND OF THE INVENTION

Field of the Invention

The present invention relates to a steel pipe obtained through quenching and tempering treatment and excellent in fatigue characteristics, especially to such a quenched/tempered steel pipe for machine structural members that has been designed to have a high strength by increasing the hardness thereof and to have a high fatigue life by precipitating fine carbides therein, and relates to a method for producing it.

Background Art

In various machine structures such as typically automobiles, often used are quenched/tempered "steel pipes" for members that are required to have a high strength and good fatigue characteristics.

In general, for improving the fatigue characteristics of steel materials, surface hardening or smoothing is said to be effective.

Patent Reference 1 discloses a technique of improving fatigue characteristics by surface hardening through nitriding treatment. Patent Reference 2 discloses a technique of improving the fatigue characteristics of steel pipes by grinding the inner surface of a steel pipe for smoothing and for decarburized layer removal.

[Patent Reference 1] JP-A 6-264177

[Patent Reference 2] JP-A 7-215038

Nowadays, various members of machine structures are increasingly required to be downsized and lightweight. High-strength members composed of steel pipes are no exceptions.

For making steel pipe members lightweight, it is most effective to reduce the pipe wall thickness thereof. However, thin-walled structures are disadvantageous in point of the strength and the fatigue life thereof. In particular, steel pipes are often worked to have a desired shape by bending or the like, but the outside wall of the bent part has a reduced thickness and is in a severe state in point of the durability. Accordingly, for satisfying the requirement for wall thickness reduction, it is desired to improve the level of the characteristics of steel pipes themselves, or that is, to elevate the fatigue life of steel pipes to a further higher level with maintaining the high strength thereof.

It is not always easy to reduce the pipe wall thickness of high-strength steel pipes with maintaining the durability thereof to that effect. As a means for solving the problem, for example, a method may be taken into consideration of improving the strength/fatigue characteristic level of steel materials themselves by addition of specific elements thereto. However, for many machine structures, such a method that may bring about material cost increase is unacceptable. The method of surface nitriding as in Patent Reference 1, and the method of inner surface grinding as in Patent Reference 2 may be effective for improving fatigue characteristics, but both involve increase in process steps; and the current steel pipe production process could not be directly applied thereto. The method of Patent Reference 2 has another problem of process yield reduction.

Accordingly, it is not easy to increase the level of the fatigue life of high-strength steel pipes with maintaining the high strength thereof according to an inexpensive method, and at present, such a method is not as yet established.

In consideration of the current situation as above, the present invention is to provide a steel pipe that is designed to have a further increased high strength and a further improved fatigue life, especially to such a steel pipe suitable for wall thickness reduction in hollow stabilizers for automobiles.

SUMMARY OF THE INVENTION

The present inventors have made assiduous studies and, as a result, have found that the fatigue life of a steel pipe can be significantly improved with maintaining the high strength of the steel pipe, even though any specific constitutive element is not added and any specific step is not employed. In other words, the inventors have known that, in the combination of the constitutive composition and the quenching/tempering condition, there is still room to consider how the fatigue life can be significantly improved; and the inventors have succeeded in finding out the "solution" and have completed the present invention.

Specifically, the invention provides a high fatigue life quenched/tempered steel pipe having a composition comprising, % by mass, C: 0.1 to 0.4%, Si: 0.5 to 1.5%, Mn: 0.3 to 2%, P: at most 0.02%, S: at most 0.01%, Cr: 0.1 to 2%, Ti: 0.01 to 0.1%, Nb: 0.01 to 0.1%, Al: at most 0.1%, B: 0.0005 to 0.01%, N: at most 0.006%, and optionally at least one of Ni: at most 0.5%, Ca: at most 0.02%, Mo: at most 0.5% and V: at most 0.5%, with a balance of Fe and inevitable impurities, in which the mean grain size of the precipitated carbides is at most 0.5 μm and of which the hardness in the center part of the wall thickness in the cross section perpendicular to the longitudinal direction of the steel pipe is at least 400 HV. In this case, for example, those having a wall thickness t of from 1 to 7 mm and an outer diameter D of the pipe of from 10 to 45 mm and satisfying $D/t \geq 4$ are preferred objects.

For producing the steel pipe of the type, there is provided a method for producing a high fatigue life quenched/tempered steel pipe, comprising quenching treatment of keeping an unquenched starting steel pipe having the above-mentioned ingredient composition at 900 to 1100° C. for 10 to 60 seconds and then rapidly cooling it, followed by tempering treatment of keeping it at 280 to 380° C. for 10 to 60 minutes. In this, preferably, an annealed steel plate having a thickness t of from 1 to 7 mm is used as the starting steel plate, and this is formed into a pipe by welding to be the starting steel pipe having an outer diameter D of from 10 to 45 mm and satisfying $D/t \geq 4$.

The invention has made it possible to significantly improve the fatigue life of high-strength steel pipes for use in various machine structural members with using inexpensive steel on the same level as that of conventional materials. Owing to the improvement in characteristics, further improvement in durability and further reduction in the wall thickness of members has been realized in hollow stabilizers for automobiles and in other steel pipes for machine structures. In producing the steel pipe of the invention, any special step is unnecessary. Accordingly, the invention contributes toward enhancing the durability of machine structural members such as typically automobile parts and toward making those members lightweight.

DESCRIPTION OF THE EMBODIMENTS

In the invention, used is a steel in which the content of each constitutive element is controlled as mentioned below. "%" indicating the alloying element content means "% by mass".

C must be in an amount of at least 0.1% for the purpose of securing the strength and the spring property necessary for high fatigue life steel pipes for machine structures. However, when too much, there may occur brittle fracture owing to toughness reduction, and there may occur a risk of fatigue life depression owing to the reduction in the grain boundary strength. If so, addition, the workability in pipe production and the soundness of the welded part may worsen. Accordingly, the C content is defined to fall within a range of at most 0.4%.

Si is an element effective for improving the quenchability and the temper softening resistance and for securing the strength of the steel after tempering. In addition, in tempering, Si prevents the formation of filmy carbides and promotes the formation of fine carbides having a mean grain size of at most 0.5 μm, thereby preventing the reduction in the grain boundary strength of steel. Si is an indispensable element for attaining high fatigue life, and must be in an amount of at least 0.5%. However, when the Si content is too high, coarse carbides may be formed in the grain boundary by which the fatigue life of steel may be rather lowered. Accordingly, the Si content is defined to be within a range of at most 1.5%.

Mn is an element effective for securing the quenchability and the strength of steel; and for fully exhibiting the effect, Mn must be in an amount of at least 0.3%. However, if too much, the carbon equivalent may increase and too much Mn may have some negative influence on the workability and the soundness of the welded part of steel. Accordingly, the Mn content is defined to be within a range of at most 2%.

P segregates in the austenite grain boundary in quenching, and owing to the reduction in the grain boundary strength, the fatigue life of steel is thereby lowered. Accordingly, the P content is defined to be at most 0.02%.

S forms MnS in steel, and this is the start point of cracking, thereby lowering the strength and the toughness of steel. In addition, S segregates in the grain boundary, therefore bringing about fatigue life reduction. Accordingly, the S content is defined to be at most 0.01%.

Like Mn, Cr is effective for improving the quenchability of steel and increases the temper softening resistance, and therefore, Cr must be in an amount of at least 0.1%. However, when the Cr content is more than 2%, the quenched/tempered texture of steel may contain a large quantity of undissolved carbides, and the carbides form start points of cracking therefore causing reduction in the toughness and the fatigue life of steel. Accordingly, the Cr content is defined to be from 0.1 to 2%.

Ti fixes N in steel as TiN therein, therefore contributing toward securing the solid solution B effective for improving the quenchability of steel. In addition, Ti prevents prior austenite grains from further growing into coarse grains in quenching, therefore improving the fatigue life of steel. For fully exhibiting the effect, the Ti content must be at least 0.01%. However, even though Ti is added in an amount more than 0.1%, the effect thereof of preventing prior austenite grains from further growing into coarse grains may be saturated, and Ti associated inclusions to be start points of fatigue fracture may rather increase. Accordingly, the Ti content is defined to be from 0.01 to 0.1%.

Nb forms carbonitrides and acts to prevent prior austenite grains from further growing into coarse grains and to improve the toughness and the fatigue life of steel. For fully exhibiting the effect, the Nb content must be at least 0.01%. However, when the Nb content is more than 0.1%, the above effect would be saturated and it would be uneconomical. Accordingly, the Nb content is defined to be from 0.01 to 0.1%.

Al is an element effective for deoxygenation and is also effective for preventing the austenite crystal grains from growing into coarse grains in quenching. As total Al (T.Al), the Al content is preferably secured to be at least 0.01%. However, too much Al, if any, may have some negative influence on the toughness and the fatigue life of the electro-seam welded part of steel. Accordingly, the Al content (T.Al) is defined to be at most 0.1%, more preferably at most 0.05%.

Addition of a minor amount of B may be effective for increasing the quenchability of steel. In addition, B reinforces the prior austenite grain boundary of quenched/tempered steel to prevent the brittle fracture thereof, and is therefore effective for improving the toughness of steel. For fully exhibiting the effect, the B content must be at least 0.0005%. However, when more than 0.01%, the effect may be saturated. Accordingly, the B content is defined to be from 0.0005 to 0.01%, more preferably falling within a range of from 0.002 to 0.01%.

N consumes B in forming EN, and is therefore a negative factor in ensuring the effect of B added to steel. Accordingly, the N content is preferably as small as possible. As a result of various investigations, the N content may be acceptable up to 0.01%, but is more preferably at most 0.006%.

Ni is effective for improving the quenchability, the toughness and the fatigue life of steel; and therefore, Ni may be added to steel, if desired. More effectively, the Ni content is secured to be at least 0.1%. However, if more than 0.5%, the above effect may be saturated and it would be uneconomical. Accordingly, the amount of Ni, if added, shall be within a range of at most 0.5%.

Ca has an effect of spheroidizing MnS-type inclusions in steel, by which the anisotropy of steel may be reduced. Accordingly, if desired, Ca may be added to steel, and more effectively, its content may be at least 0.001%. However, if too much, Ca associated inclusions may increase in steel, thereby having some negative influence on the fatigue characteristics of steel. Accordingly, the amount of Ca, if added, shall be within a range of at most 0.02%.

Mo is an element effective for improving the quenchability and the temper softening resistance of steel, and is therefore secondarily added for preventing the toughness degradation to be caused by excess addition of Mn and Cr. More effectively, the Mo content, if any, is secured to be at least 0.1%. However, Mo is an expensive element, and too much addition thereof detracts from the economical potential of the invention. Accordingly, Mo addition, if any, shall be within a range of at most 0.5%.

V has an effect of refining the crystal grains in quenching, and is effective for improving the toughness of steel; and therefore, V is optionally added to steel. More effectively, the V content is secured to be at least 0.1%. However, V is also an expensive element, and too much addition thereof detracts from the economical potential of the invention. Accordingly, V addition, if any, shall be within a range of at most 0.5%.

The starting steel pipe having the chemical composition as above is processed for quenching and tempering as defined in the invention thereby giving a steel pipe having a significantly improved fatigue life with maintaining the high strength thereof.

For producing the steel pipe, employable is a method of producing a seamless steel pipe from a billet; however, a method comprising preparing a "starting steel plate" from a hot-rolled steel plate or a cold-rolled steel plate by annealing followed by working it into a steel pipe by high-frequency welding or the like is more suitable for mass-production of steel pipes. The "starting steel plate" for pipe production is preferably a sufficiently-softened annealed steel plate in order that the plate is durable to deformation in pipe production and to bending operation after pipe production. Preferably, a starting steel plate softened and annealed in a temperature range lower than the $Ac_1$ point thereof is used for pipe production. The annealed texture of steel to which the invention is directed comprises nearly "ferrite+1.5 to 6 vol. % carbide".

If desired, the formed steel pipe may be, while still in a soft state before quenching treatment, worked and formed into a steel pipe member having a desired shape. In this, the steel pipe optionally worked and formed to have a desired shape before quenching treatment is referred to as "starting steel pipe". The present inventors' studies have revealed that, when the starting steel pipe having the above-mentioned chemical composition is quenched and tempered and when the tempering treatment is attained in a low temperature range, then a significant improvement in the fatigue life of the quenched/tempered steel pipe can be realized.

Concretely, when the starting steel pipe having the above-mentioned composition range is processed for quenching treatment of "keeping it at 900 to 1100° C. for 10 to 60 seconds and then rapidly cooling it" followed by tempering treatment of "keeping it at 280 to 380° C. for 10 to 60 minutes", then the fatigue life of the thus-processed steel pipe can be significantly improved while the hardness in the center part of the wall thickness in the cross section perpendicular to the longitudinal direction of the steel pipe (hereinafter this may be referred to as "cross section C") is kept on a strength level of at least 400 HV. "Rapid cooling" in the quenching treatment is at a cooling speed enough to undergo martensitic transformation, for which, for example, employable is "cooling in water" by dipping the steel pipe in water.

For use for hollow stabilizers and the like that are required to have a high strength, preferably used are those having a high strength of such that the hardness in the center part of the wall thickness in the cross section C is on a strength level of at least 400 HV; and when the starting steel pipe having the above-mentioned composition range is processed for the above-mentioned quenching/tempering treatment, then the thus-processed steel pipe can satisfy the high strength level.

As the cross section C in which the hardness of the steel pipe is evaluated, selected is a part except the site where the cross-sectional profile has greatly changed by the process of working the pipe into the intended member (for example, bending treatment). Concretely, the maximum value of the wall thickness in the cross section C is represented by $t_{max}$ and the minimum value thereof is by $t_{min}$, and the part where $(t_{max}-t_{min})/t_{max}$ is at most 0.2 is selected and its hardness is measured.

The present inventors' detailed investigations have revealed that, when coarse precipitated carbides exist in a steel pipe member, the member could hardly realize an excellent and stable fatigue life even though its strength level is high. Concretely, it is important that the mean grain size of the precipitated carbides is controlled to be at most 0.5 μm.

Of the steel pipes to which the invention is directed, those having a wall thickness t of from 1 to 7 mm, preferably from 1 to 5 mm, and an outer diameter D of the pipe of from 10 to 45 mm, and satisfying D/t of at least 4 are suitable for steel pipes for hollow stabilizers. As compared with conventional hollow stabilizers formed of steel of the same kind as that in the invention, the steel pipes of the invention are more lightweight and can realize hollow stabilizers having high strength and high fatigue life characteristics on a level comparable to or higher than that of the conventional ones.

EXAMPLE 1

A steel in Table 1 was smelted, the slab was heated at 1250° C. for 60 minutes, then extracted, hot-rolled (for rough rolling and finish rolling), and wound to a coil at 530° C. After the hot rolling, the plate thickness was 5.6 mm or 8 mm. Thus obtained, the hot-rolled steel plate was washed with acid. The hot-rolled steel plate having a thickness of 5.6 mm was a "hot-rolled" plate not processed any more; or this was thereafter annealed in a hydrogen atmosphere at 690° C. for 18 hours to be a "hot-rolled/annealed" plate. The hot-rolled steel plate having a thickness of 8 mm was thereafter cold-rolled by 30% and then annealed in a hydrogen atmosphere at 690° C. for 18 hours to be a "cold-rolled/annealed" plate having a thickness of 5.6 mm. The annealing temperature is not lower than the recrystallization temperature but not higher than the $Ac_1$ point. These "hot-rolled" steel plate, "hot-rolled/annealed" steel plate and "cold-rolled/annealed" steel plate are referred to as starting steel plates.

TABLE 1

| | | Chemical Composition (mass %) | | | | | | | | | | | | | | |
|---|---|---|---|---|---|---|---|---|---|---|---|---|---|---|---|---|
| Classification | Steel | C | Si | Mn | P | S | Cr | Ti | Nb | T.Al | B | N | Ni | Ca | Mo | V |
| Comparative steel | A | 0.07 | 0.81 | 1.23 | 0.016 | 0.003 | 0.16 | 0.02 | 0.02 | 0.021 | 0.005 | 0.0041 | — | — | — | — |
| Comparative steel | B | 0.45 | 0.63 | 0.46 | 0.011 | 0.004 | 1.67 | 0.02 | 0.02 | 0.013 | 0.004 | 0.0035 | — | — | — | — |
| Comparative steel | C | 0.32 | 2.12 | 0.68 | 0.010 | 0.006 | 0.52 | 0.05 | 0.05 | 0.022 | 0.005 | 0.0033 | — | — | — | — |
| Steel of the invention | D | 0.23 | 1.05 | 0.87 | 0.012 | 0.006 | 0.33 | 0.02 | 0.05 | 0.019 | 0.004 | 0.0052 | — | — | — | — |
| Comparative steel | E | 0.27 | 0.52 | 2.25 | 0.011 | 0.002 | 1.02 | 0.02 | 0.03 | 0.021 | 0.006 | 0.0041 | — | — | — | — |
| Steel of the invention | F | 0.22 | 0.69 | 0.72 | 0.009 | 0.008 | 1.11 | 0.04 | 0.04 | 0.024 | 0.006 | 0.0039 | — | — | — | — |
| Comparative steel | G | 0.30 | 0.74 | 0.36 | 0.014 | 0.007 | 2.22 | 0.03 | 0.07 | 0.020 | 0.004 | 0.0047 | — | — | — | — |
| Comparative steel | H | 0.31 | 1.07 | 0.85 | 0.025 | 0.014 | 0.59 | 0.03 | 0.05 | 0.012 | 0.004 | 0.0036 | — | — | — | — |
| Comparative steel | I | 0.29 | 0.63 | 0.47 | 0.013 | 0.007 | 0.85 | 0.13 | 0.14 | 0.018 | 0.007 | 0.0048 | — | — | — | — |
| Comparative steel | J | 0.25 | 1.43 | 1.25 | 0.009 | 0.008 | 1.23 | — | — | 0.025 | 0.005 | 0.0037 | — | — | — | — |
| Steel of the invention | K | 0.26 | 1.15 | 1.39 | 0.012 | 0.005 | 1.47 | 0.03 | 0.06 | 0.023 | 0.006 | 0.0052 | — | 0.04 | — | — |
| Steel of the invention | L | 0.14 | 0.66 | 0.65 | 0.008 | 0.003 | 0.81 | 0.04 | 0.03 | 0.032 | 0.004 | 0.0039 | — | — | 0.38 | — |
| Steel of the invention | M | 0.37 | 0.80 | 1.33 | 0.013 | 0.008 | 0.46 | 0.03 | 0.05 | 0.028 | 0.005 | 0.0051 | — | — | — | 0.26 |

TABLE 1-continued

| Classification | Steel | Chemical Composition (mass %) | | | | | | | | | | | | | | |
|---|---|---|---|---|---|---|---|---|---|---|---|---|---|---|---|---|
| | | C | Si | Mn | P | S | Cr | Ti | Nb | T.Al | B | N | Ni | Ca | Mo | V |
| Steel of the invention | N | 0.29 | 1.43 | 0.86 | 0.015 | 0.004 | 1.75 | 0.02 | 0.02 | 0.033 | 0.009 | 0.0045 | 0.34 | — | — | — |
| Steel of the invention | O | 0.32 | 0.65 | 0.85 | 0.013 | 0.005 | 1.39 | 0.04 | 0.03 | 0.021 | 0.008 | 0.0038 | — | — | — | — |
| Comparative steel | P | 0.24 | 0.99 | 1.77 | 0.008 | 0.003 | 0.72 | 0.05 | 0.03 | 0.033 | 0.0002 | 0.0034 | — | — | — | — |
| Comparative steel | Q | 0.18 | 0.73 | 0.23 | 0.010 | 0.005 | 0.56 | 0.04 | 0.02 | 0.039 | 0.004 | 0.0035 | — | — | — | — |
| Steel of the invention | R | 0.37 | 0.82 | 0.58 | 0.011 | 0.018 | 1.53 | 0.03 | 0.03 | 0.035 | 0.007 | 0.0041 | — | — | — | — |
| Steel of the invention | S | 0.13 | 0.76 | 1.53 | 0.013 | 0.008 | 0.87 | 0.02 | 0.04 | 0.029 | 0.005 | 0.0045 | — | — | — | — |
| Comparative steel | T | 0.23 | 0.22 | 0.44 | 0.012 | 0.007 | 0.29 | 0.02 | — | 0.033 | 0.004 | 0.0036 | — | 0.03 | — | — |

Underlined: outside the scope of the invention.

Heat treatment of quenching/tempering treatment after pipe formation was simulated with the above-mentioned, starting steel plate, by which the hardness of the steel plate, the mean grain size of the carbides in the steel plate and the fatigue characteristics of the steel plate were determined.

The quenching treatment was under the condition of "keeping the steel plate at 800 to 1200° C. for 10 to 60 seconds followed by cooling in water".

The tempering treatment was under the condition of "keeping the steel plate at 200 to 420° C. for 10 to 60 minutes followed by cooling in air".

The hardness was measured in the center part of the wall thickness in the cross section C (cross section perpendicular to the rolling direction) of the steel plate, using a Vickers microhardness tester.

The mean grain size of the carbides was determined as follows: In the visual field with TEM (transmission electronic microscope), 30 carbides were randomly selected in total, and the major diameter of each carbide was measured. The data were averaged to give the mean grain size of the carbides.

The fatigue characteristics were evaluated in a metal plate bending fatigue test according to JISZ2275, in which the maximum bending stress was 750 $N \cdot mm^{-2}$. The sample of which the fracture lifetime in this test is at least 50,000 is recognized to have a significantly improved fatigue life as compared with conventional hollow stabilizer materials. In this, those of which the fracture lifetime is at least 50,000 are evaluated as good (O); and those of which the fracture lifetime is less than 50,000 are evaluated as not good (x).

The results are shown in Table 2.

TABLE 2

| Classification | No. | Steel | Starting Steel Plate | Quenching Treatment temperature (° C.) | Quenching Treatment time (sec) | Tempering Treatment temperature (° C.) | Tempering Treatment time (min) | Hardness of Cross Section C (HV) | Mean Grain Size of Precipitated Carbides (μm) | Fatigue Life fracture lifetime ($\times 10^4$) | Fatigue Life evaluation |
|---|---|---|---|---|---|---|---|---|---|---|---|
| Comparative Example | 1 | A | hot-rolled | 900 | 30 | 280 | 30 | 362 | 0.39 | 2.10 | X |
| Comparative Example | 2 | B | hot-rolled | 1050 | 30 | 380 | 45 | 508 | 0.75 | 3.24 | X |
| Comparative Example | 3 | C | hot-rolled | 950 | 60 | 340 | 60 | 519 | 0.83 | 3.50 | X |
| Example of the Invention | 4 | D | hot-rolled | 1000 | 60 | 340 | 45 | 463 | 0.24 | 8.70 | ○ |
| Example of the Invention | 5 | | cold-rolled/ annealed | 1000 | 30 | 280 | 45 | 481 | 0.22 | 9.83 | ○ |
| Example of the Invention | 6 | | hot-rolled | 1100 | 60 | 380 | 45 | 442 | 0.27 | 9.05 | ○ |
| Comparative Example | 7 | | hot-rolled/ annealed | 850 | 30 | 340 | 45 | 375 | 0.81 | 3.80 | X |
| Comparative Example | 8 | | hot-rolled | 1200 | 10 | 340 | 45 | 424 | 0.66 | 4.32 | X |
| Comparative Example | 9 | | hot-rolled | 1050 | 30 | 200 | 45 | 527 | 0.25 | 2.99 | X |
| Comparative Example | 10 | | hot-rolled | 1050 | 30 | 420 | 45 | 371 | 0.32 | 4.01 | X |
| Comparative Example | 11 | E | hot-rolled | 1100 | 60 | 380 | 60 | 336 | 0.46 | 1.89 | X |
| Example of the Invention | 12 | F | hot-rolled | 1000 | 30 | 280 | 30 | 478 | 0.34 | 8.08 | ○ |
| Example of the Invention | 13 | | hot-rolled | 1100 | 60 | 340 | 30 | 435 | 0.37 | 7.83 | ○ |
| Example of the Invention | 14 | | cold-rolled/ annealed | 900 | 10 | 380 | 30 | 419 | 0.36 | 9.52 | ○ |
| Comparative Example | 15 | G | hot-rolled | 1100 | 60 | 340 | 45 | 469 | 0.74 | 3.54 | X |
| Comparative Example | 16 | H | hot-rolled | 900 | 60 | 380 | 45 | 415 | 0.39 | 2.35 | X |
| Comparative Example | 17 | I | hot-rolled | 1000 | 60 | 280 | 60 | 413 | 0.40 | 3.01 | X |
| Comparative Example | 18 | J | hot-rolled | 1000 | 60 | 380 | 30 | 429 | 0.30 | 1.99 | X |
| Example of the Invention | 19 | K | hot-rolled | 1050 | 60 | 340 | 45 | 427 | 0.35 | 6.03 | ○ |
| Example of the Invention | 20 | L | hot-rolled | 900 | 10 | 280 | 45 | 459 | 0.39 | 6.95 | ○ |
| Example of the Invention | 21 | M | hot-rolled | 950 | 30 | 340 | 60 | 422 | 0.41 | 7.52 | ○ |
| Example of the Invention | 22 | N | hot-rolled | 1000 | 10 | 380 | 30 | 474 | 0.39 | 6.35 | ○ |
| Example of the Invention | 23 | O | hot-rolled | 1100 | 60 | 380 | 30 | 453 | 0.32 | 6.11 | ○ |
| Comparative Example | 24 | P | hot-rolled | 1000 | 60 | 340 | 60 | 359 | 0.33 | 2.04 | X |
| Comparative Example | 25 | Q | hot-rolled | 950 | 10 | 340 | 45 | 358 | 0.35 | 2.88 | X |

TABLE 2-continued

| Classification | No. | Steel | Starting Steel Plate | Quenching Treatment temperature (° C.) | Quenching Treatment time (sec) | Tempering Treatment temperature (° C.) | Tempering Treatment time (min) | Hardness of Cross Section C (HV) | Mean Grain Size of Precipitated Carbides (μm) | Fatigue Life fracture lifetime ($\times 10^4$) | Fatigue Life evaluation |
|---|---|---|---|---|---|---|---|---|---|---|---|
| Example of the Invention | 26 | R | hot-rolled/ annealed | 1050 | 60 | 340 | 30 | 436 | 0.29 | 6.57 | ○ |
| Example of the Invention | 27 | S | hot-rolled | 900 | 30 | 280 | 45 | 414 | 0.30 | 6.14 | ○ |
| Comparative Example | 28 | T | hot-rolled | 950 | 30 | 340 | 45 | 379 | 0.69 | 3.33 | X |

Underlined: outside the scope of the invention.

As known from Table 2, in No. 1 (steel A), No. 24 (steel P) and No. 25 (steel Q) of Comparative Examples, the content of C, B and Mn were lower than the range defined in the invention. Their quenchability was poor, and therefore the hardness of the steels after tempering was low, and the fatigue life thereof could not be improved. In No. 11 (steel E), the Mn content was too high and the residual austenite phase increased. Accordingly, its hardness lowered after tempering owing to the reduction in the hardness after tempering treatment, and the fatigue life of the steel was short. In No 28 (steel T), the Si content was low and the hardness after tempering treatment of the steel was low. In addition, since Nb was not added to this, coarse carbide precipitates larger than 0.5 μm were formed in the grain boundaries, and as a result, the grain boundary strength of the steel was lowered and the fatigue life thereof was short. In No. 2 (steel B), No. 3 (steel C) and No. 15 (steel G), the C, Si and Cr content was high. In No. 18 (steel J), Ti and Nb were not added. In these, coarse carbide precipitates larger than 0.5 μm were formed in the grain boundaries, and as a result, the grain boundary strength of the steel was lowered and the fatigue life thereof was short. In No. 17 (steel I), Ti and Nb were added each in an amount overstepping the scope of the invention. In these, coarse carbides of Ti and Nb were formed, and these carbides acted as the start points for fatigue fracture and the fatigue life of the steel was thereby shortened. In Nos. 7 to 10, the steel D had a composition falling within the scope of the invention, for which, however, the quenching/tempering condition was outside the scope of the invention. Specifically, in No. 7, the quenching temperature was too low, and therefore the solid solution was insufficiently formed, the hardness after tempering was low and the fatigue life was short. In No. 8, the quenching temperature was too high, and therefore, coarse carbide precipitates were formed and the fatigue life was short. In No. 9, the tempering temperature was too low, and in No. 10, the tempering temperature was too high. In these, therefore, the hardness after tempering was outside the scope of the invention and the fatigue life was short.

As opposed to these, the examples of the invention which were all within the scope of the invention in point of the chemical composition and the quenching/tempering condition exhibited a strength level of at least 400 HV, and in these, the mean grain size of the carbide precipitates was not larger than 0.5 μm, and the fatigue life was on a level of more than 50,000 times and was very good. In this, "plate materials" were tested for the characteristics after quenching/tempering; however, "tubular materials" also show the same tendency in point of the influence of the quenching/tempering condition on the improvement of the strength and on the improvement of the fatigue life thereof. Specifically, when the starting steel pipe having the composition defined in the invention is processed for quenching/tempering treatment under the condition defined in the invention, then the strength and the fatigue characteristics of the steel pipe are significantly improved, and various machine structure members such as typically hollow stabilizers comprising the thus-processed steel pipe of the invention can be significantly improved in point of the fatigue life thereof.

EXAMPLE 2

The steel D, the steel E and the steel G in Table 1 were processed according to the same process as in Example 1, and the thus cold-rolled/annealed steel plates were used as starting steel plates. The starting steel plate was formed into a pipe through high-frequency welding, thereby producing three types of steel pipes a, b and c each having an outer diameter of 30 mm. The steel pipes a and b each had a wall thickness of 3 mm; and the steel pipe c had a wall thickness of 5 mm. The steel pipes thus formed by welding (starting steel pipes) were cut into a length of 1 m. These were processed for quenching treatment of "keeping at 950 to 1050° C. (at the temperature shown in Table 3) for 30 seconds followed by rapidly cooling in water" and tempering treatment of "keeping at 340° C. for 45 minutes followed by cooling in air". Subsequently, the outer surface of the steel pipe was processed for shot-peening treatment. After the quenching/tempering treatment, the steel pipe (steel pipe member) was analyzed for the hardness in the center part of the wall thickness in the cross section C, according to the same process as in Example 1.

A straight pipe sample 1 m in length was cut out of the above-mentioned steel pipe, and tested according to a fatigue test in which 100 mm of both ends of the steel pipe were fastened and twisting stress was given to the steel pipe in the circumferential direction thereof. In this, a strain gauge was fitted to the outer surface in the center part in the longitudinal direction of the steep pipe, and a twisting stress of 700 $N \cdot mm^{-2}$ was imparted to the sample. In this test, when the fracture lifetime is 70,000 times or more, then the sample is recognized to have a greatly increased fatigue life as compared with conventional hollow stabilizers. In this, therefore, the samples having a fracture lifetime of at least 70,000 times were evaluated as good (O), and those less than the level were evaluated as not good (x).

The results are shown in Table 3.

TABLE 3

| Classification | Steel Pipe | Steel | Plate thickness (mm) | Quenching Treatment temperature (° C.) | Quenching Treatment time (sec) | Tempering Treatment temperature (° C.) | Tempering Treatment time (min) | Hardness of Cross Section C (HV) | Mean Grain Size of Precipitated Carbides (μm) | Fatigue Life fracture lifetime ($\times 10^4$) | Fatigue Life evaluation |
|---|---|---|---|---|---|---|---|---|---|---|---|
| Example of the Invention | a | D | 3 | 1000 | 30 | 340 | 45 | 463 | 0.24 | 9.25 | ○ |
| Comparative Example | b | E | 3 | 1050 | 30 | 340 | 45 | 336 | 0.46 | 4.04 | X |
| Comparative Example | c | G | 5 | 950 | 30 | 340 | 45 | 469 | 0.74 | 5.05 | X |

Underlined: outside the scope of the invention.

As known from Table 3, the steel pipe a of the invention has an increased high strength of not lower than 400 HV, and in this, the mean grain size of the precipitated carbides was not larger than 0.5 μm. Accordingly, though its wall was thinned, the steel pipe a had better fatigue characteristics than the steel pipe c having a thick wall (having a higher Cr content). The steel pipe b (having a high Mn content) could not attain improved fatigue characteristics when its wall was thin.

What is claimed is:

1. A method for producing a high fatigue life quenched/tempered steel pipe, comprising quenching treatment: of keeping an unquenched starting steel pipe having a composition that comprises, % by mass, C: 0.1 to 0.4%, Si: 0.65 to 1.5%, Mn: 0.3 to 2%, P: at most 0.02% S: at most 0.01%, Cr: 0.1 to 2%, Ti: 0.01 to 0.1%, Nb: 0.01 to 0.1%, Al: at most 0.1% B: 0.0005 to 0.01%, and N: at most 0.01%, with a balance of Fe and inevitable impurities, at 900 to 1100° C. for 10 to 60 seconds and then cooling the pipe such that the pipe undergoes martensitic transformation, followed by tempering treatment of keeping it at 280 to 380° C. for 10 to 60 minutes.

2. The method for producing a high fatigue life quenched/tempered steel pipe as claimed in claim 1, wherein the starting steel pipe further contains at least one of Ni: at most 0.5%, Ca: at most 0.02%, Mo: at most 0.5% and V: at most 0.5%.

3. The method for producing a high fatigue life quenched/tempered steel pipe as claimed in claim 1, wherein the starting steel pipe is formed by welding a steel plate having a wall thickness t of from 1 to 7 mm into a pipe having an outer diameter D of from 10 to 45 mm and satisfying $D/t \geq 4$.

* * * * *